US005790004A

United States Patent [19]

Matsuoka et al.

[11] Patent Number: 5,790,004

[45] Date of Patent: Aug. 4, 1998

[54] ELECTROMAGNETIC RELAY

[75] Inventors: Kazushige Matsuoka; Tsuyoshi Nishida; Taisuke Ueda, all of Kyoto, Japan

[73] Assignee: OMRON Corporation, Kyoto, Japan

[21] Appl. No.: 780,812

[22] Filed: Jan. 9, 1997

[30] Foreign Application Priority Data

Jan. 11, 1996 [JP] Japan ..... 8-003147

[51] Int. Cl.[6] ..... H01H 51/22

[52] U.S. Cl. ..... 335/78; 335/80

[58] Field of Search ..... 335/78–86, 124, 335/128, 131

[56] References Cited

U.S. PATENT DOCUMENTS 5,274,348 12/1993 Vernier et al. ..... 335/78

5,455,550 10/1995 Von Allen et al. ..... 335/78

*Primary Examiner*—Lincoln Donovan

*Attorney, Agent, or Firm*—Morrison & Foerster LLP

[57] ABSTRACT

An electromagnetic relay has a core and yoke that are securely attached to the base of the relay with a high degree of precision so that the operating characteristics of the relay do not vary. To this end, two bosses are provided near the lower edge on the inner surface of a hole in a spool of the relay. The bosses are symmetrical with respect to a center line of the spool.

10 Claims, 4 Drawing Sheets

ELECTROMAGNETIC RELAY

BACKGROUND OF THE INVENTION

The invention is directed to an electromagnetic relay.

BACKGROUND OF THE INVENTION

An example of an existing electromagnetic relay is shown in FIG. 4. To reduce the number of parts, coil 2 is wrapped around a spool 1*a* formed as a single piece with base 1. An L-shaped yoke 3 is inserted from above into a hole provided in the center of the base 1. A core 4 is inserted from above into the central hole 1*b* of the spool 1*a*. The protruding upper end of the core serves as magnetic pole 4*a*. The protruding lower end, 4*b*, is caulked to the horizontal portion of the yoke 3 to form electromagnetic element 5.

In this prior art electromagnetic relay, movable member 7, which is supported by hinged spring 6 on the upper end of the yoke 3 and is free to move, is made to rotate by the presence or absence of excitation in the electromagnetic element 5. The rotation of member 7 causes movable contact terminal 8, which is anchored in the base 1, to rotate. The movable contact 8*a* on this terminal is caused to meet or move away from fixed contact 9*a* on fixed contact terminal 9.

In the electromagnetic relay described above, reinforcement ribs cannot be created on the upper surface of base 1 to secure the attachment of yoke 3 to the base, because this would interfere with the wrapping of coil 2 on spool 1*a*. Therefore, the supporting length of yoke 3 with the base 1 is necessarily limited, and securely attaching yoke 3 to base 1 with a high degree of precision is prevented. This may result in varying operating characteristics.

Another problem is the length of core 4. For core 4 to be forced into central hole 1*b* of spool 1*a* and fixed there, the hole must be formed with a high degree of precision. This increases the difficulty of manufacturing the parts. Even when a hole 1*b* has been created into which the entirety of core 4 can be inserted and fixed, a great deal of force is needed to drive the core into the hole. This results in a difficult assembly process. Consequently, existing relays have a central hole 1*b* formed to allow a microscopic space between the outer surface of core 4 and the inner surface of hole 1*b*. As a result, core 4 is liable to rattle. This also may result in varying operating characteristics.

SUMMARY OF THE INVENTION

The invention provides an electromagnetic relay having an internal configuration that allows the yoke and the core to be securely fixed to the base with a high degree of precision in the assembly process. This reduces variations in operating characteristics of different relays.

A coil is wrapped around a spool formed integrally with a base. An iron core is inserted from above into the central hole in this spool. A magnetic pole is formed on the upper end of the core that protrudes from the spool. The lower protruding end of the core forms an electromagnetic element caulked to the horizontal portion of an L-shaped yoke. This yoke is inserted from below into a through hole in the base. The presence or absence of excitation causes the contact to open or close. Several bosses are provided on the interior surface of the central hole in the spool. These bosses, which serve as supports, are near the lower edge of the hole, and may be provided in other places as well.

The bosses may alternatively be provided on the interior surface of the hole in the spool between the core and yoke.

The angle between two of the bosses, which are placed so that they are linearly symmetric with respect to a center line perpendicular to the axis of the central hole, may be between 80° and 130°.

Other features and advantages will become apparent from the following description, including the drawings, and from the claims.

BRIEF DESCRIPTION OF THE DRAWING

FIG. 3(*b*) is a bottom view of the base of the electromagnetic relay of FIG. 1.

FIG. 3(*c*) is an enlarged view of components on the bottom of the base of the electromagnetic relay of FIG. 1.

DETAILED DESCRIPTION OF THE INVENTION

Figure 1:
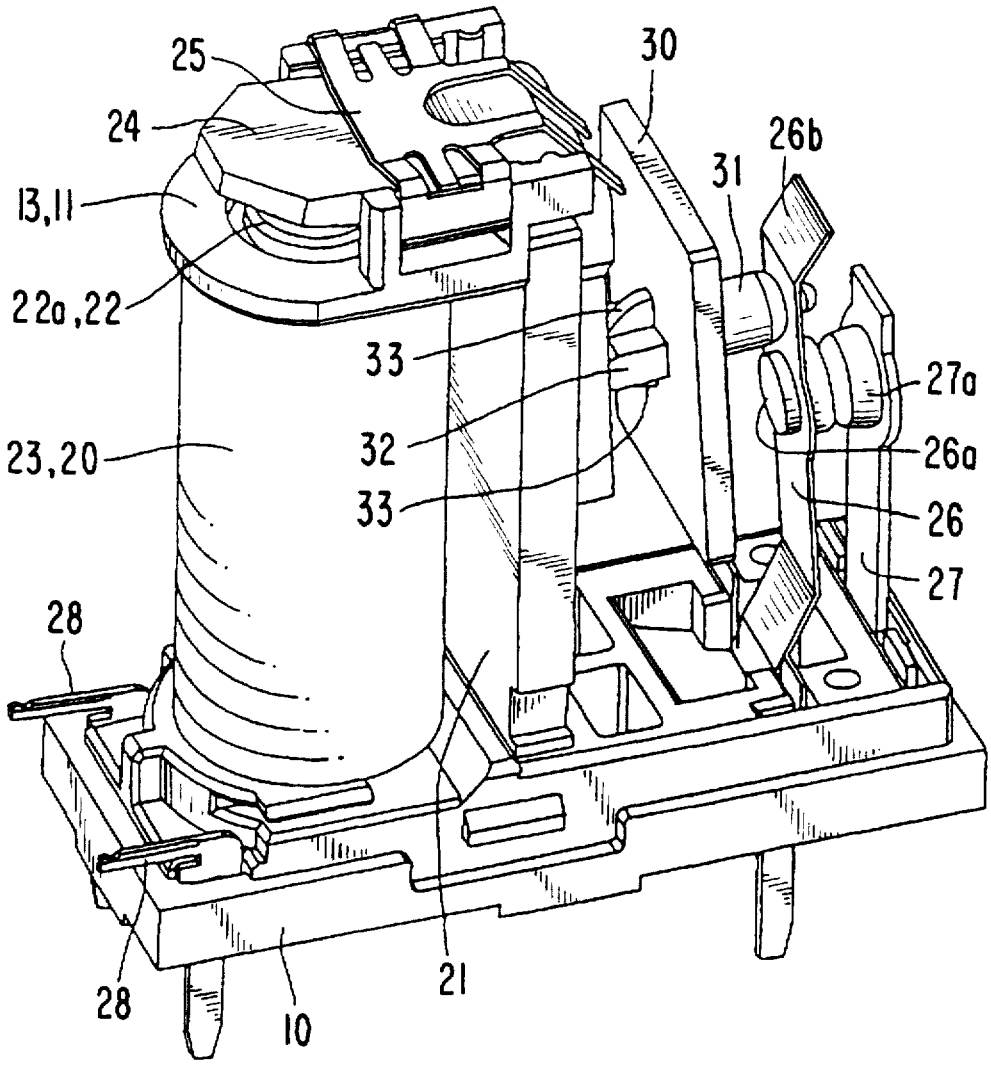
FIG. 1 is a perspective drawing of an electromagnetic relay of this invention.
Figure 2:
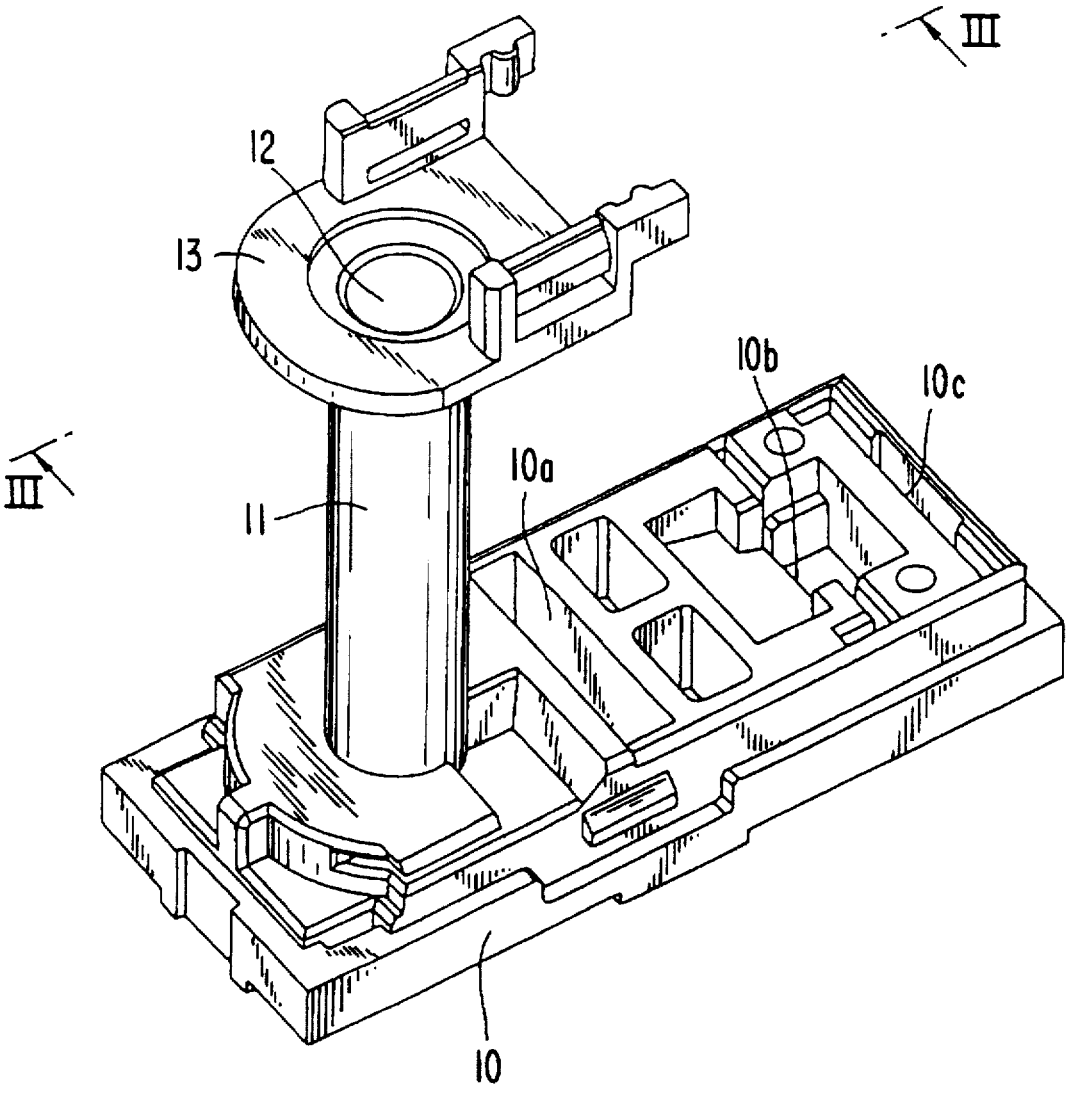
FIG. 2 is a perspective drawing of the electromagnetic base of the relay pictured in FIG. 1.
Figure 3A:
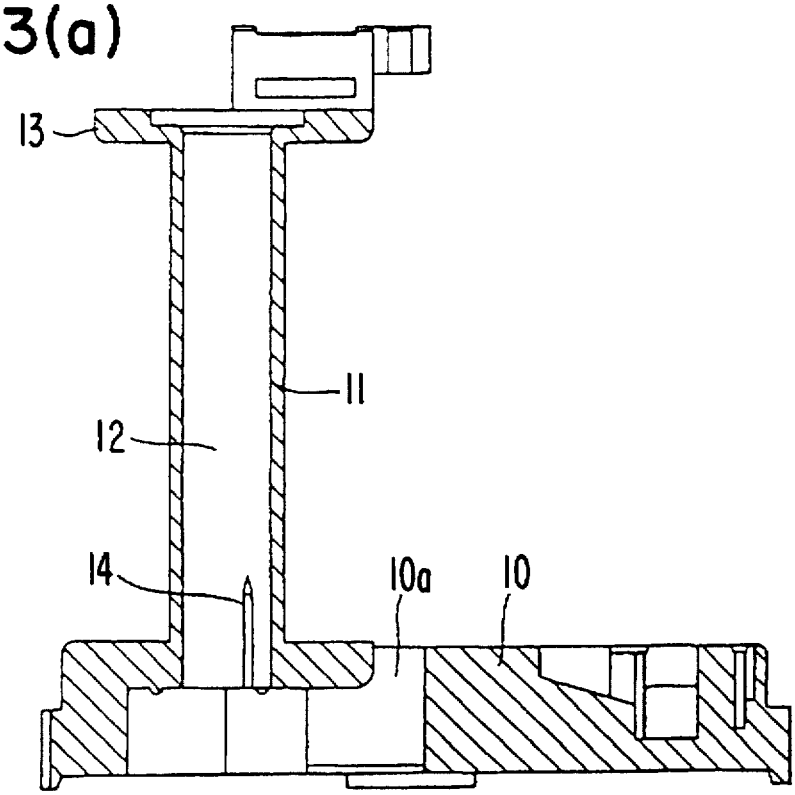
FIG. 3(*a*) is a sectional view of the base of the electromagnetic relay of FIG. 2 taken along section III—III.
Figure 3B:
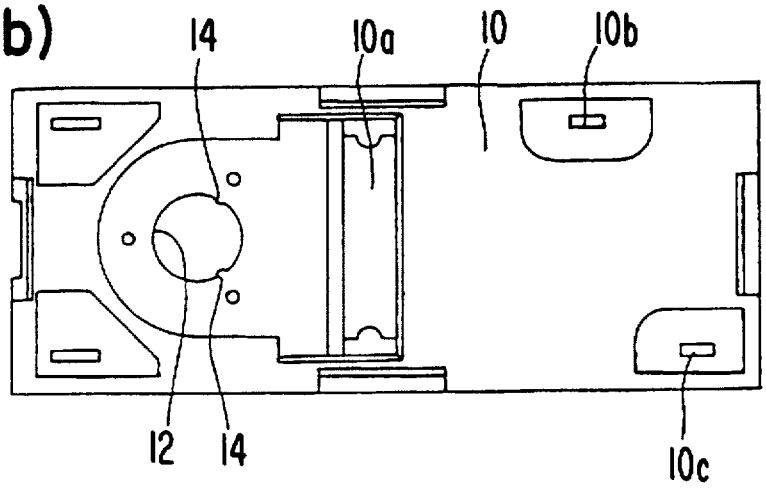
Figure 3C:
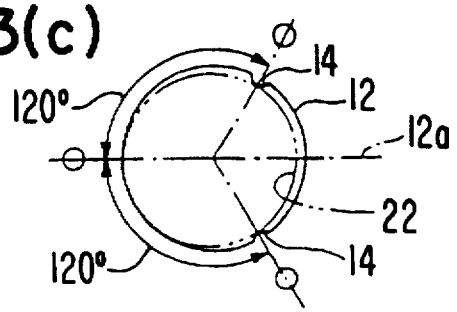
Figure 4:
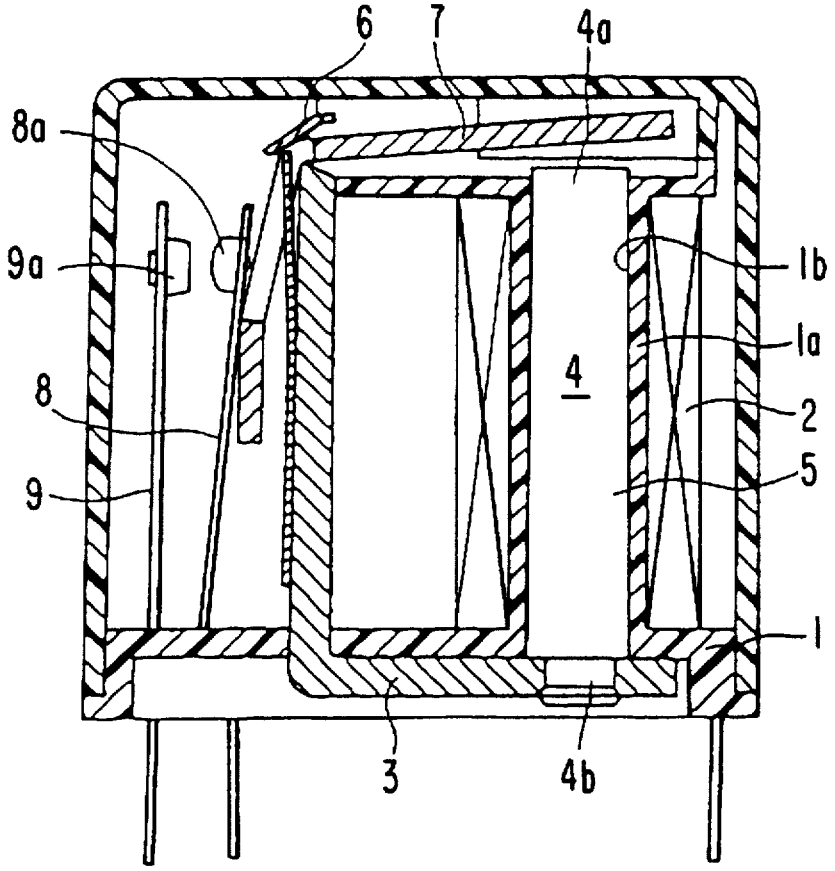
FIG. 4 PRIOR ART
FIG. 4 is a cross section of a prior art electromagnetic relay.

Referring to FIGS. 1–3, an electromagnetic relay has an electromagnetic element 23, which comprises spool 11 and base 10, of which spool 11 is an integral part. As can be seen in FIG. 2, spool 11 has a central hole 12, into which core 22, which will be discussed below, is to be inserted. On the upper end of the spool is rim 13. Near the base of spool 11 is slot 10*a*, into which yoke 21, which will be discussed below, is to be inserted.

As can be seen in FIG. 3, the spool 11 has two bosses 14 which are formed on the interior surface of hole 12 at its lower edge, between yoke 21 and core 22. These bosses 14, as shown in FIG. 3 (*c*), are in locations which are symmetrical with respect to center line 12*a* and form two angles of 120° each with that line. When core 22 is inserted into the central hole 12 and comes to contact with the bosses, the bosses will be deformed by the pressure of the core 22. Thus, the core 22 can be held tightly by these bosses. Another purpose of these bosses is to separate core 22 as far as possible from the vertical portion of yoke 21 to reduce the flux leakage and ensure that the relay will remain stable in its assembled state.

It is not critical that there are two bosses 14. One boss would also be acceptable, as would three or more. These bosses 14 must be positioned so that the angles discussed above are no greater than 180°, and they should at least exceed 90°.

Bosses 14 may also extend continuously from the lower edge of hole 12 to its upper edge. The force needed to drive core 22 into the hole may be adjusted by adjusting the length of bosses 14 appropriately. This simplifies the design.

Coil 20 is wrapped around the spool 11, and yoke 21, which has been bent into an L shape, is inserted from bottom into through hole 10*a* in the base 10. The upper end of the core that protrudes from the hole serves as magnetic pole 22*a*. The lower end of the core is caulked to the horizontal portion of yoke 21 (not pictured) to form an electromagnetic element 23 that is integral to base 10.

Movable member 24, which is bent into the shape of a shallow V, is supported on the upper end of the yoke 21 by hinged spring 25 so member 24 is free to move. Movable terminal 26, the terminal for movable contact 26*a*, and fixed terminal 27, the terminal for fixed contact 27*a*, are forced into and secured in slots 10*b* and 10*c* in the base 10. The upper end 26*b* of the movable contact terminal 26 is bent outward.

Card 30, on whose front and rear surfaces are protrusions 31 and 32, is placed vertically between the vertical portion of movable member 24 and movable contact terminal 26. Protrusion 31 slides along portion 26*b* of movable contact terminal 26, and it engages in the aperture in terminal 26. Protrusion 32 on card 30 engages in the aperture (not pictured) in the vertical portion of movable member 24. This completes the assembly of the internal components.

Components 28 in FIG. 1 are the coil terminals. The wire drawn out from coil 20 is tied and soldered to the horizontal ends of these terminals, which are then bent toward the sides.

In this embodiment, there are two rounded projections 33 at the base of protrusion on card 30 to prevent the protrusion from getting stuck in the aperture. This insures that card 30 will not get hung up on movable member 24 and simplifies the assembly process.

When no voltage is applied to coil 20, electromagnetic element 23 is not excited, and the spring force of movable contact terminal 26 pushes card 30 toward element 23. Movable contact 26*a* moves away from fixed contact 27*a*.

When voltage is applied to coil 20 and electromagnetic element 23 is excited, the horizontal portion of movable member 24 is drawn toward magnetic pole 22*a* of core 22. Member 24 rotates against the spring force of movable contact terminal 26, which is pushed by card 30 so that its terminal 26*a* contacts fixed contact terminal 27*a*. The horizontal portion of movable member 24 adheres to pole 22*a* of core 22.

When voltage is no longer applied to coil 20, the spring force of movable contact terminal 26 pushes card 30 back, movable member 24 rotates in the opposite direction, and movable contact 26*a* moves away from fixed contact 27*a* and reverts to its original position.

As should be clear from the above explanation, the electromagnetic relay of this invention has several bosses near the lower edge of the hole in the center of the spool, which is formed integrally with the base. These bosses, which support the core, allow the core to be securely immobilized in the hole of the spool with a high degree of precision during assembly. They also allow the yoke to be securely caulked to the core with a high degree of precision so that the operating characteristics of the relay will not vary.

These bosses are provided close to the lower edge of the hole in the spool between the core and the yoke. This allows the core to be held well away from the yoke to reduce flux leakage and prevent any decrease in attraction.

The angle between two bosses that are symmetric with respect to a center line orthogonal to the axis of the hole is approximately between 80° and 130°. This scheme allows the core to be held in the hole in the spool in a stable state.

Other embodiments are within the scope of the following claims.

What is claimed is:

1. An electromagnetic relay, comprising:

a coil wrapped around a spool formed integrally with a base;

a metal core inserted from above into a central hole in said spool;

a magnetic pole formed on an upper end of said metal core which protrudes from said spool;

an L-shaped yoke inserted from below into said base, said L-shaped yoke being fixed to a lower protruding end of said metal core;

a movable member being free to move which is supported on an upper end of said L-shaped yoke by a hinged spring;

a movable contact terminal having a movable contact actuated by said movable member;

a fixed terminal having a fixed contact to accept said movable contact; and a boss on an interior surface of said central hole in said spool to hold said metal core in said central hole in a stable state.

2. An electromagnetic relay according to claim 1, wherein said boss is close to said lower edge of said central hole in said spool.

3. An electromagnetic relay according to claim 1, wherein said boss is provided between said core and said L-shaped yoke.

4. An electromagnetic relay according to claim 1, wherein a plurality of said boss are provided between said core and said L-shaped yoke.

5. An electromagnetic relay according to claim 4, wherein said plurality of said boss are linearly symmetric with a center line perpendicular to an axis of said central hole.

6. An electromagnetic relay according to claim 5, wherein an angle between said plurality of said boss is between 80° and 130°.

7. An electromagnetic relay according to claim 1, wherein said boss is formed integrally with said spool.

8. An electromagnetic relay according to claim 1, wherein said boss is deformed by a pressure of said metal core so as to hold said metal core tightly when said metal core is inserted into said central hole and contacts said boss.

9. An electromagnetic relay according to claim 1, wherein a cross section of said boss is triangular.

10. An electromagnetic relay according to claim 1, wherein a cross section of said boss is a half circle.

* * * * *